US008635814B2

(12) United States Patent
Griggio et al.

(10) Patent No.: US 8,635,814 B2
(45) Date of Patent: Jan. 28, 2014

(54) WALL FOR INTERIOR ARCHITECTURE

(75) Inventors: Luca Griggio, Cittadella (IT); Eddy Canton, Cittadella (IT)

(73) Assignee: Giplanet SpA, Cittadella (PD) (IT)

( * ) Notice: Subject to any disclaimer, the term of this patent is extended or adjusted under 35 U.S.C. 154(b) by 0 days.

(21) Appl. No.: 13/391,370

(22) PCT Filed: Sep. 15, 2010

(86) PCT No.: PCT/IB2010/054180
§ 371 (c)(1),
(2), (4) Date: Feb. 20, 2012

(87) PCT Pub. No.: WO2011/033465
PCT Pub. Date: Mar. 24, 2011

(65) Prior Publication Data

US 2012/0160432 A1 Jun. 28, 2012

(30) Foreign Application Priority Data

Sep. 17, 2009 (IT) ..... PD2009A0271

(51) Int. Cl.
*E04B 1/82* (2006.01)

(52) U.S. Cl.
USPC ..... 52/79.1; 52/481.2; 52/144; 52/145

(58) Field of Classification Search
USPC ..... 52/79.1, 481.2, 239, 238.1, 241, 242, 52/144, 145
See application file for complete search history.

(56) References Cited

U.S. PATENT DOCUMENTS

| | | | | |
|---|---|---|---|---|
| 2,274,851 | A * | 3/1942 | Schneider | 442/286 |
| 5,737,893 | A | 4/1998 | Rossiter | |
| 6,688,056 | B2 * | 2/2004 | Von Hoyningen Huene et al. | 52/243.1 |
| 6,722,096 | B2 * | 4/2004 | Von Arx et al. | 52/511 |
| 6,729,085 | B2 * | 5/2004 | Newhouse et al. | 52/239 |
| 2006/0042141 | A1 | 3/2006 | Hansen | |

FOREIGN PATENT DOCUMENTS

| | | |
|---|---|---|
| DE | 202008015609 | 3/2009 |
| WO | 03076741 | 9/2003 |

* cited by examiner

*Primary Examiner* — Mark Wendell
(74) *Attorney, Agent, or Firm* — Themis Law

(57) ABSTRACT

The invention is a wall for interior architecture, particularly for partitioning adjacent rooms, comprising a substantially rigid frame (2) suited to define an external perimeter surface (4) of the wall (1), and one pair of opposite faces (3) constrained to the rigid frame (2) and made of a flexible material. In particular, the opposite faces (3) comprise elastic constraining means (5) suited to maintain them tensioned and substantially parallel to a geometrical plane, while the rigid frame (2) and the opposite tensioned faces (3) delimit an internal hollow region (6).

18 Claims, 5 Drawing Sheets

WALL FOR INTERIOR ARCHITECTURE

FIELD OF APPLICATION

This invention is generally suitable for architecture and furnishing applications, and in particular it relates to a wall for interior architecture of the type described in the preamble of claim 1.

STATE OF THE ART

Numerous examples of lightweight walls for partitioning rooms are known, suited to be installed and if necessary disassembled and/or easily moved, so as to adapt interior spaces to different needs. This type of wall is especially useful to create interior environments needed for short periods of time, such as exhibition spaces at fairs or similar events.

Patent document WO9958780 describes a lightweight partition panel comprising a frame consisting of four rigid profiles joined by four corner connectors. One or more rigid layers of fibreboard and an insulating layer are fastened to said frame, defining two opposite faces of said lightweight panel. Said faces are covered with fabric secured to said frame by inserting the edge of the fabric inside two perimeter grooves created along said four profiles and said four corner connectors. The two grooves face outward and are continuous along the external perimeter of the panel. The fabric is secured on both faces with the aid of a rubber profile inserted inside the perimeter grooves to compress and hold the fabric.

Patent document U.S. Pat. No. 5,737,893 describes a lightweight panel similar to the above, having a panel core made of composite material. In this case, the outer fabric can be secured to the panel by inserting the edges of the fabric inside a pair of perimeter grooves, or through a perimeter swelling or a continuous rib along the edge of the fabric.

One obvious disadvantage common to these two known solutions lies in the fact that under the outer fabric there is still a rigid layer or panel that cannot be bent to reduce the overall dimensions and, therefore, the storage, transport and assembly/disassembly operations of said panels are difficult due to their weight and size.

A further disadvantage of the known solutions is represented by the fact that the methods used to secure the outer fabric to the frame are not easy to implement and provide questionable efficacy in keeping the panel tensioned. In particular, given that the perimeter swellings or continuous ribs along the edge of the fabric have limited elasticity for both natural and synthetic fabrics, inserting them into the perimeter grooves is by no means an easy job, as well as maintaining the fabric under tension over time. The securing of the fabric is also limited even if the edges are bound to the frame through the insertion of a rubber profile in the perimeter grooves or if the edges lack said perimeter swellings or said continuous ribs. In the latter case the effectiveness of the binding method is also questionable, as the edge of the fabric can easily disengage from the perimeter grooves.

DESCRIPTION OF THE INVENTION

A primary object of the invention is to eliminate the aforementioned drawbacks, creating a wall system that is easy to install and simultaneously enables the creation of comfortable indoor spaces.

One particular object of the invention is to provide a wall having reduced dimensions when disassembled, so as to significantly facilitate transport and storage operations.

Another object of the invention is to provide a wall which is particularly lightweight and that can be moved and adapted to different needs with extreme ease.

Another particular object is to provide a wall with high aesthetic value. These and other objects which will emerge hereafter are achieved, according to claim 1, by means of a wall for interior architecture, particularly designed for the partition of adjacent rooms, comprising a substantially rigid frame suited to define an outer perimeter surface of the wall, and a pair of opposing faces made of flexible material secured to said rigid frame; in particular, said opposing faces comprise elastic constraining means to maintain them tensioned and substantially parallel to a geometrical plane, wherein said rigid frame and said opposing tensioned faces delimit a hollow internal region.

Thanks to this particular configuration it will be possible to obtain a wall that is particularly light, versatile, and easy to transport.

BRIEF DESCRIPTION OF THE DRAWINGS

The characteristics of the new wall for interior architecture will be better explained by the following description with reference to the drawings attached by way of a non-limiting example.

DETAILED DESCRIPTION OF A PREFERRED EMBODIMENT OF THE INVENTION

Figure 1B:
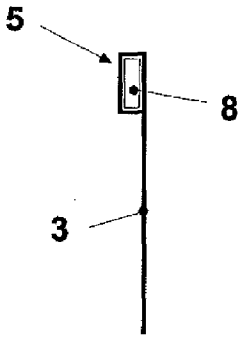
FIG. 1*b* shows a detailed view of the edge of the faces made of flexible material.
Figure 1A:
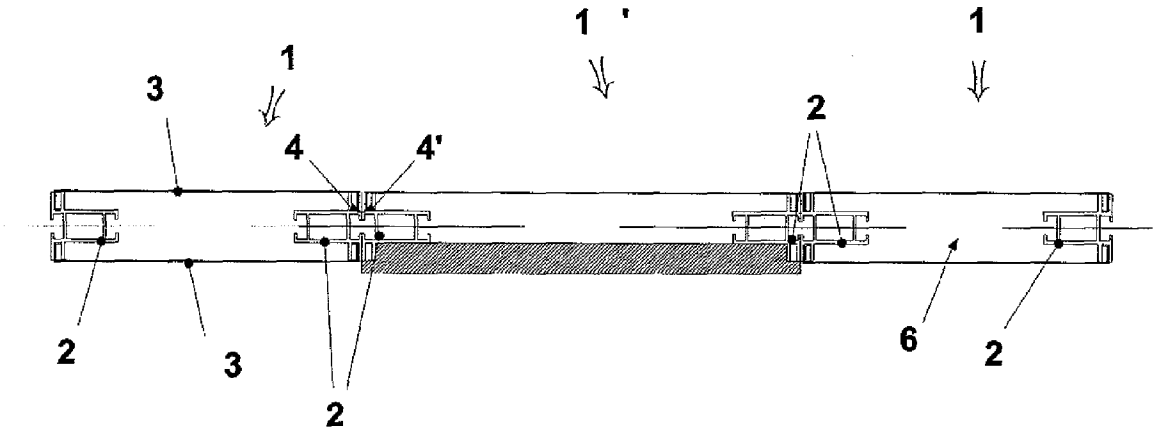
FIG. 1*a* shows a wall composed of three walls.
Figure 1:
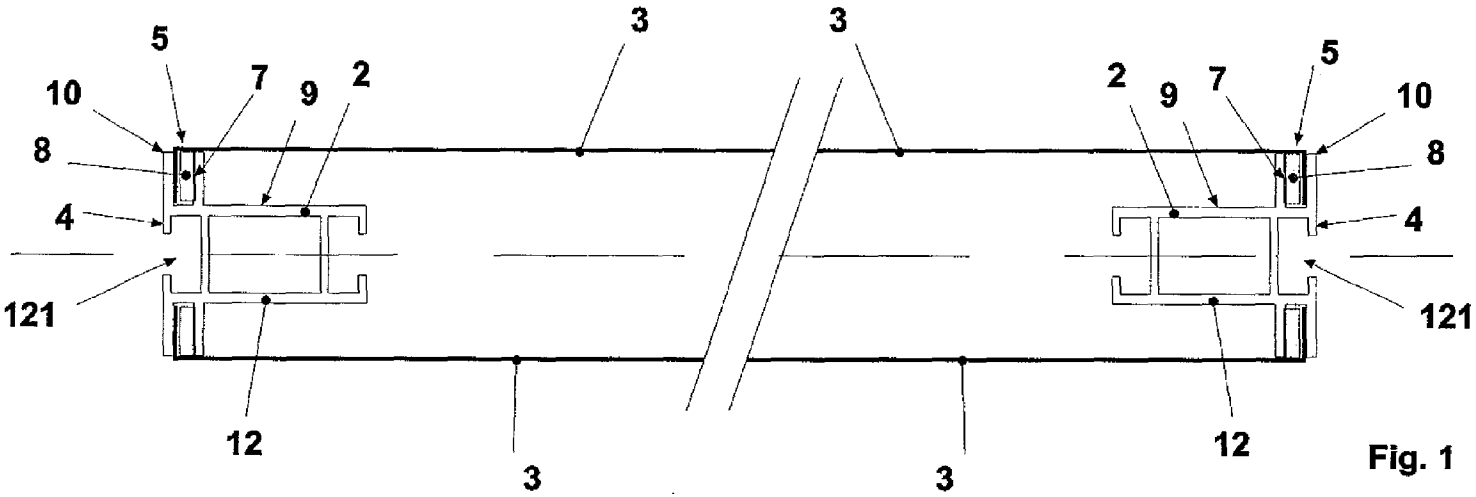
FIG. 1 shows a cross-section view of the wall.

The wall is described with particular reference to the attached figures, the reference numbers used in the description and in the claims are used to improve the intelligibility of the text and do not constitute any limitation to the protection claimed.

The wall according to the invention for interior architecture, particularly suitable for the partition of adjacent rooms, is indicated as a whole by reference number 1. The wall 1 comprises a substantially rigid frame 2 to which a pair of opposing faces 3 is secured. The rigid frame 2 defines an outer perimeter surface 4 of the wall 1. The opposing faces 3 are made of flexible material, and in particular they may be made of fabric or other similar materials. In addition, each opposing face 3 may comprise a single layer of fabric or a plurality of layers, even of different flexible materials, to increase the sound absorption capacity of the wall 1.

Said opposing faces 3 are conveniently made of stretch fabric and/or fabric containing elastic fibres so as to maintain suitable surface tension of the opposing faces 3 after installation even in the case of thermal expansion, stress, air movement and more.

This elastic material can be a simple monochrome or two-tone fabric or Jacquard type fabric in different colours and/or have different weft and warp yarn thickness and can be printed on and/or embroidered.

Preferably said fabric composing said opposing faces 3 is made of polyester with a basis weight of 300 gr/m$^2$.

The opposing faces 3 made of Jacquard fabric allow each face 3 to be reversible, that is, to have two different colours and/or designs on the two sides. As a result, by assembling the face 3 in one way or the other the appearance of the wall can be changed quickly to provide a different look without having to replace the entire face 3.

In addition, Jacquard fabric does not have the defect of becoming deformed or damaged as a result of perforations, by nails or screws for example.

A distinctive feature of the invention is that the opposing faces 3 comprise constraining means 5, or enlarged linear elements, sewn or otherwise secured to the perimeter edge of the fabric of the opposing faces 3, suited to maintain them tensioned and substantially parallel to a geometrical plane (not shown in the attached figures). In addition, the tension generated by the constraining means 5 on the opposing faces 3 causes the latter, together with the rigid frame 2, to delimit an internal hollow region 6. The presence of the internal region 6 results in a very lightweight wall 1 without affecting its rigidity thanks to the presence of the rigid frame 2.

Said rigid frame 2, comprising the section bars 12, may have a pair of grooves 7 on said section bars 12, while the constraining means 5 may comprise an enlarged edge 8 integral with the perimeter of each opposing face 3. The enlarged edge 8 may be shaped so as to be pressure-fitted into a corresponding groove 7. In addition, the enlarged edge 8 may be sized so as to ensure, through its elasticity, the proper tension on the opposing faces 3. A stable coupling between the edge 8 and the corresponding face 3 may be achieved by stitching, welding or another fastening method.

The pair of grooves 7 may be positioned on the rigid frame 2 along two opposite walls 9, parallel to said geometrical plane. In particular, each groove 7 can be positioned substantially at a corner 10 of the external perimeter surface 4. In this way the external perimeter surface 4 will be free of obstructions and can be easily and effectively put alongside a corresponding external perimeter surface 4' of another adjacent wall 1'. The modularity of the wall 1 enables the implementation of extended walls featuring different sizes and shapes.

Figure 2:
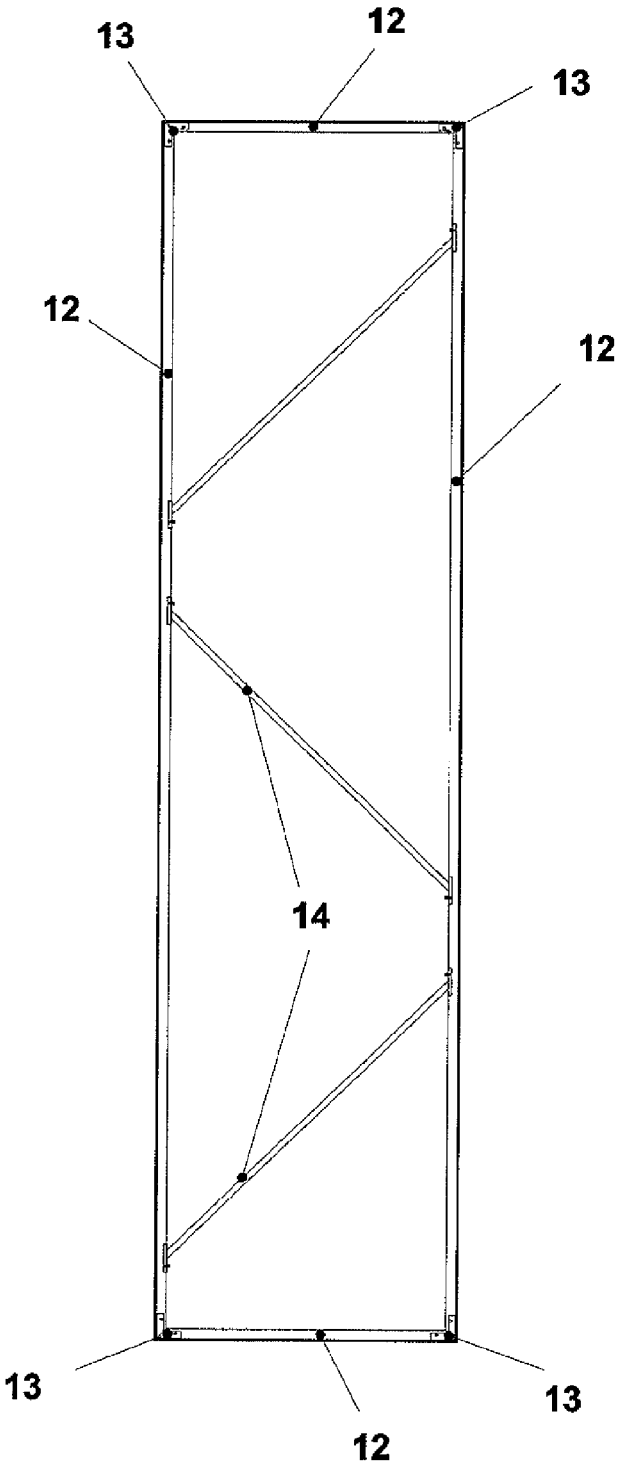
FIG. 2 shows a front view of the wall frame featuring internal section bars.
Figure 2A:
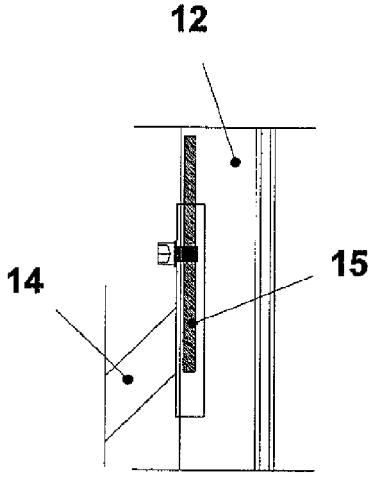
FIG. 2*a* shows a detail of the connection of the internal section bars to the profiles composing the frame.
Figure 3:
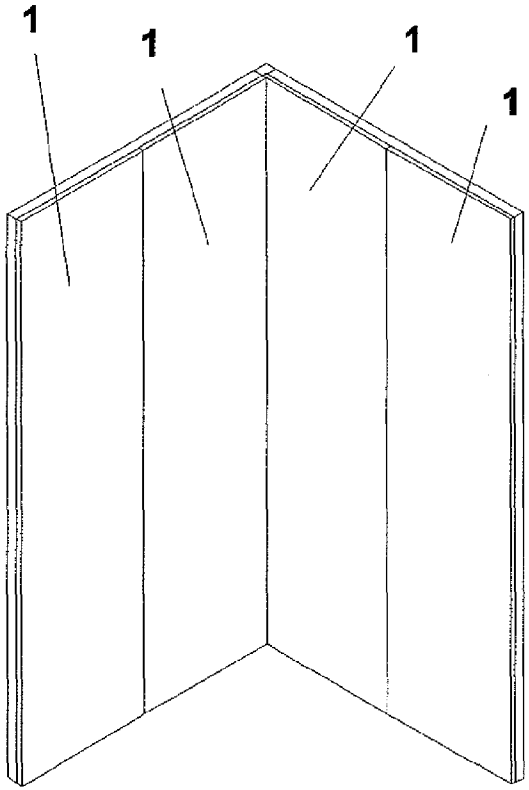
FIG. 3 shows an axonometric projection of two walls arranged at an angle.
Figure 4:
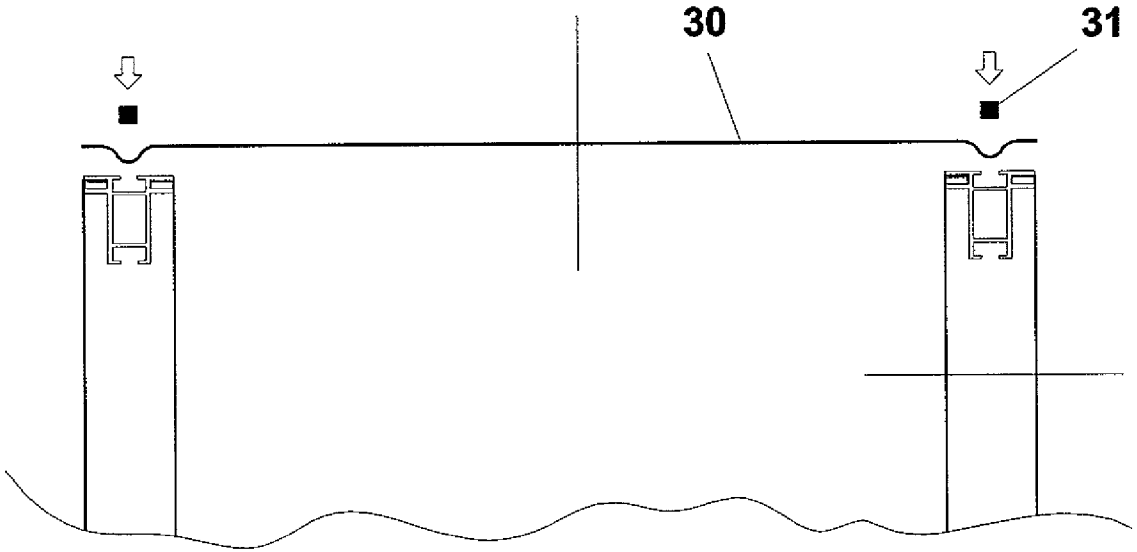
FIG. 4 shows a partial vertical cross section of two walls with the covering applied to the upper side.
Figure 5A:
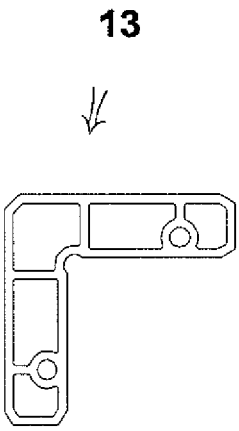
FIG. 5*a* shows a corner connector between two sides of the wall frame.
Figure 5:
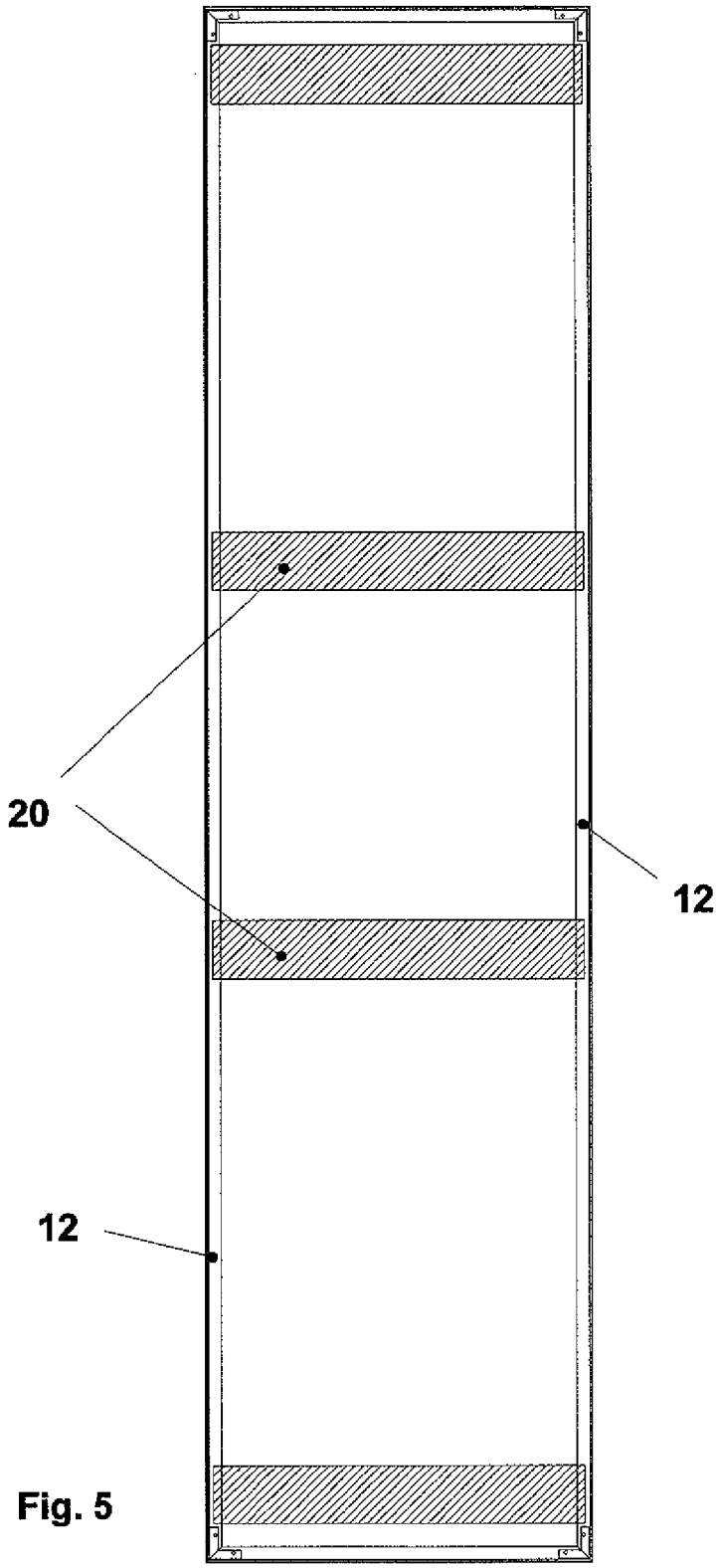
FIG. 5 shows a partial vertical cross section of the wall equipped with supporting crosspieces.

An example of embodiment of the wall according to the invention is shown in the figures where the edge of the face 3 has a swelling 8 substantially running along the entire length of the edge itself, so as to improve the coupling within said grooves 7 and prevent any total or partial detachment of the edge of the face 3 from the rigid frame 2. The swelling 8 may be made of a polymeric material, in particular rubber or another elastomer, so as to provide the desired flexibility and simultaneously make it easier to press-fit it into the grooves 7. The same elasticity of the edge of the face 3 provided with the swelling 8 will also allow for the easy separation of the opposing faces 3 from the rigid frame 2 during the disassembly of the part. As illustrated in FIG. 2, which shows the wall without the opposing faces 3, the rigid frame 2 may comprise a plurality of perimeter section bars 12 and first releasable means 13 to selectively constrain said perimeter section bars 12 to each other. In addition, the wall 1 may comprise internal section bars 14, positioned in the internal hollow region 6. Another embodiment of the invention may comprise second releasable means 15 to selectively constrain said internal section bars 14 to said perimeter section bars 12. In particular, the second releasable means 15 may constrain the longitudinal ends of the internal section bars 14 to the perimeter section bars 12. The use of the first 13 and possibly of the second releasable means 15 enables the simple and rapid assembly and disassembly of the wall 1 without the need to move large and heavy panels.

Both the perimeter section bars 12 and the internal section bars 14 can be made of an aluminium alloy.

The new wall also comprises stiffening crosspieces 20 capable of being secured to the frame 2, that is, to one or two or more perimeter section bars 12, internally, between two fabrics. Said stiffening crosspieces 20 are able to support light fixtures, paintings, pictures, posters, etc.

The section bar 12 comprises a groove 121 particularly useful for the application and securing of a top fabric 30 with corresponding means of constraint 31 to cover the area between two walls 1.

The new wall, which can be assembled directly on site, is stored and shipped in bundles containing section bars arranged side by side while the fabrics with swollen edges are stored in layers or rolls. Said fabrics with swollen edges, which can be made with a suitable string sewn to the edge of the fabric or by heat sealing, can be made of non-toxic PVC or natural elastic fabric.

In particular, said fabrics comprising swollen edges are conveniently made of stretch fabric and/or fabric containing elastic fibres, so as to maintain adequate tension of the surface of the opposing faces 3 after installation even in response to thermal expansion, stress, air movement, and the like. Said stretch fabric can be a simple monochrome or two-tone, polychrome or Jacquard type fabric in different colours and/or having different weft and warp yarn thickness, and can be printed on and/or embroidered.

Preferably said fabric forming said opposing faces 3 is made of polyester with a basis weight of 300 g/m$^2$.

The opposing faces 3 made of Jacquard fabric allow each face 3 to be reversible or with two different colours and/or designs on the sides. As a result, by assembling the face 3 in one way or the other the appearance of the wall can be changed quickly to provide a different look without having to replace the entire face 3.

Jacquard fabric, furthermore, does not pose the drawback of becoming deformed or damaged as a result of perforations, for example by nails or screws.

The new wall is completely dry assembled with basic tools like a screwdriver and a wheel for the insertion of the swollen edge into the groove.

The raw materials used, aluminium and cloth, do not have a high risk of fire and have a low fire load.

The same frame can be reused with new and different sheets that may be white, printed, or painted as a function of the different decorative needs. The new wall can be particularly useful in fairs and temporary exhibitions in general, where it is necessary to assemble stands in limited time and with contained costs but may also be used to create partitions for homes, offices, hotels, shops, or meeting rooms in general.

From the above, it is clear that the wall according to the invention attains the pre-established goals and in particular, thanks to its lightness and ease of assembly and disassembly, makes it possible to partition, in an effective and easy manner, adjacent rooms or to construct exhibition spaces for trade fairs or other similar events.

Therefore, with reference to the above description and attached drawings, the following claims are made.

The invention claimed is:

1. A wall for interior architecture, in particular for partitioning adjacent rooms, comprising:

a substantially rigid frame defining an external perimeter surface of the wall; and one pair of opposite faces provided on lateral sides of said wall, said opposite faces being constrained to said rigid frame and made of a flexible material, wherein said rigid frame defines a first and a second groove on said lateral sides of said wall, said first and second groove being configured to engage constraining portions of said opposite faces, and wherein said constraining portions maintain said opposite faces tensioned and substantially parallel to a geometrical plane, said rigid frame and said opposite tensioned faces delimiting an internal hollow region.

2. The wall according to claim 1, wherein said rigid frame further defines a flat surface on said external perimeter surface of said wall, said flat surface having a third groove defined therein and configured to receive a joining member disposed between said wall and an adjacent wall.

3. The wall according to claim 1, wherein said constraining portions are elastic and comprise an edge integral with a perimeter of each of said opposite faces and configured to be pressure-fitted into the first or the second groove.

4. The wall according to claim 3, wherein each one of said opposite faces is made of a stretch fabric or a fabric comprising elastic fibers, and wherein the edge of each one of said opposite faces is fixed to an enlarged linear element configured to be pressure-fitted into the first or the second groove.

5. The wall according to claim 3, wherein said first and said second groove are parallel to said geometrical plane.

6. The wall according to claim 3, wherein said first and said second groove are substantially at opposite corners at a level of said external perimeter surface.

7. The wall according to claim 3, wherein said edge is provided with an enlarged portion substantially along an external length of said edge.

8. The wall according to claim 1, further comprising internal reinforcing section bars positioned in said internal hollow region.

9. The wall according to claim 8, wherein said rigid frame comprises a plurality of perimeter section bars, further comprising releasable devices that selectively constrain said internal reinforcing section bars to said perimeter section bars.

10. The wall according to claim 9, wherein said perimeter section bars and said internal reinforcing section bars are in aluminum alloy.

11. The wall according to claim 1, wherein said flexible material of said opposite faces is a fabric having one or more layers.

12. The wall according to claim 1, wherein said flexible material of said opposite faces is a Jacquard fabric.

13. The wall according to claim 1, wherein said flexible material of said opposite faces is a Jacquard fabric having different weft or warp yarn color or thickness.

14. The wall according to claim 1, wherein said flexible material of said opposite faces is a Jacquard fabric having different colors or designs on two sides of the Jacquard fabric.

15. The wall according to claim 1, wherein said flexible material of said opposite faces is a fabric adapted for printing or embroidering.

16. The wall according to claim 1, wherein said flexible material of said opposite faces is polyester.

17. The wall according to claim 1, wherein said flexible material of said opposite faces has a basis weight of 300 $g/m^2$.

18. The wall according to claim 9, further comprising one or more stiffening crosspieces, made integral with said perimeter section bars of the frame for supporting lighting equipment, pictures, and any other item to be hung on the wall.

* * * * *